US008474950B2

(12) United States Patent
Okada

(10) Patent No.: US 8,474,950 B2
(45) Date of Patent: Jul. 2, 2013

(54) INKJET RECORDING APPARATUS

(75) Inventor: Goro Okada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 578 days.

(21) Appl. No.: 12/326,096

(22) Filed: Dec. 1, 2008

(65) Prior Publication Data

US 2009/0141077 A1 Jun. 4, 2009

(30) Foreign Application Priority Data

Nov. 30, 2007 (JP) ..... 2007-310906

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 7,311,376 | B2 * | 12/2007 | Gast et al. | 347/33 |
| 7,427,131 | B2 * | 9/2008 | Okamoto et al. | 347/104 |
| 2004/0246324 | A1 * | 12/2004 | Nakashima | 347/104 |
| 2007/0229578 | A1 * | 10/2007 | Yokozawa et al. | 347/23 |

FOREIGN PATENT DOCUMENTS

JP 2006-240232 A 9/2006

* cited by examiner

*Primary Examiner* — Matthew Luu
*Assistant Examiner* — Alejandro Valencia
(74) *Attorney, Agent, or Firm* — Baker Botts L.L.P.

(57) ABSTRACT

The recording apparatus includes a conveyor and a recording head which records an image to a recording medium being conveyed by the conveyor. The conveyor includes a circumferential wall, and conveys a recording medium placed on an outer circumferential surface of the circumferential wall, by rotation of the circumferential wall. The recording head includes an ejection surface where a plurality of nozzles are open, which nozzles eject at least one liquid droplet. The circumferential wall includes a tube-shaped base, and one or more detachable plates detachably attached to an external surface of the base.

17 Claims, 16 Drawing Sheets

INKJET RECORDING APPARATUS

CROSS REFERENCE TO RELATED APPLICATION

The present application claims priority from Japanese Patent Application No. 2007-310906, which was filed on Nov. 30, 2007, the disclosure of which is herein incorporated by reference in its entirety.

BACKGROUND OF THE INVENTION

1. Field of the Invention

The present invention relates to a recording apparatus which records an image on a recording medium conveyed by a conveyor belt.

2. Description of the Related Art

As an inkjet printer which forms an image by ejecting an ink droplet to a sheet serving as a recording medium, Japanese Unexamined Patent Publication 240232/2006 (Tokukai 2006-240232) discloses one including a conveyor which conveys a sheet placed on an outer circumferential surface of an endless conveyor belt looped around a plurality of rollers.

SUMMARY OF THE INVENTION

The inkjet printer mentioned above may require replacement of the conveyor belt, due to a contamination caused by ink on a conveyor surface of the conveyor belt, or deterioration of the conveyor belt over time. A complicated procedure is necessary to replace the conveyor belt, such as removing a shaft-supporter of a roller around which the conveyor belt is looped. Thus, a complicated procedure is necessary to replace a member such as a contaminated or deteriorated conveyor belt, which constructs a part of a conveyor.

An object of the present invention is to provide a recording apparatus which allows easy replacement of a contaminated or deteriorated member which constructs a conveyor.

The present invention is a recording apparatus including: a conveyor which includes a circumferential wall, and which conveys a recording medium placed on an outer circumferential surface of the circumferential wall with rotation of the circumferential wall; and a recording head including an ejection surface where a plurality of nozzles are open, which records an image to a recording medium being conveyed by the conveyor by ejecting at least one liquid droplet from the nozzles, the ejection surface being positioned so as to face the outer circumferential surface of the circumferential wall, wherein the circumferential wall includes a tube shaped base, and one or more detachable plates detachably attached to an external surface of the base.

With the present invention, one or more detachable plates are detachably attached to an external surface of abase. Thus, the one or more detachable plates are easily replaceable.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

<First Embodiment>

Figure 1:
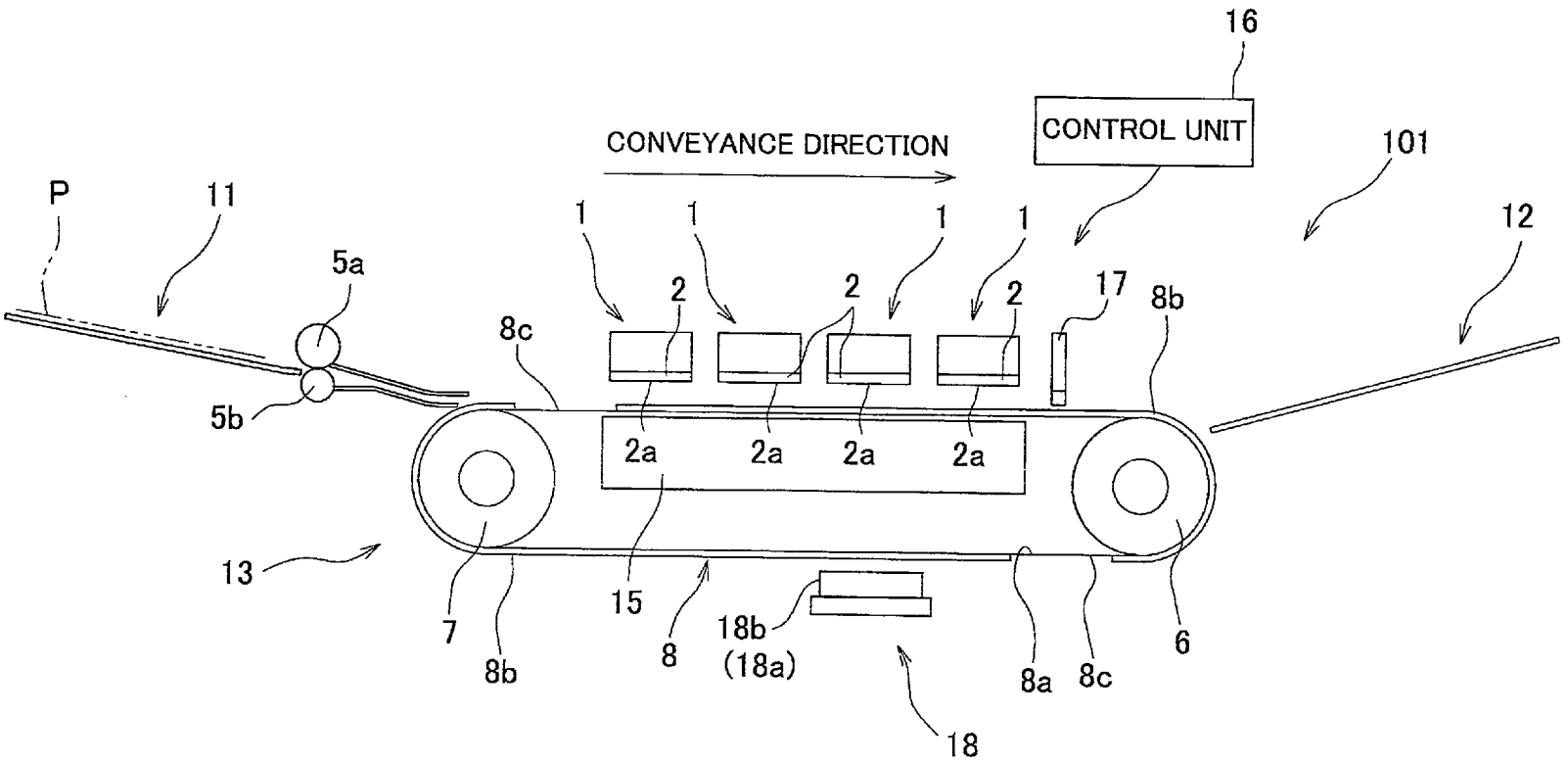
FIG. 1 is a side view of an inkjet printer according to the first embodiment of the present invention.

As illustrated in FIG. 1, an inkjet printer 101 of a first embodiment, according to the present invention is a color inkjet printer including four inkjet heads 1 which eject four different colors of ink (yellow, magenta, cyan, and black), respectively. The inkjet printer 101 includes a sheet feed tray 11 and a sheet discharge tray 12 on the left and the right of FIG. 1, respectively.

Inside the inkjet printer 101 is a conveyance path through which a sheet P serving as a recording medium is conveyed from a sheet feed tray 11 towards a sheet discharge tray 12. Immediately downstream of the sheet feed tray 11 are a pair of feed rollers 5*a* and 5*b* arranged, which sandwich and convey a sheet. The feed rollers 5*a* and 5*b* convey a sheet P from the sheet feed tray 11 towards the right in FIG. 1. The sheet P conveyed by the feed rollers 5*a* and 5*b* is supplied to a conveyor 13. The conveyor 13 includes: two belt rollers 6 and 7; an endless conveyor belt 8 looped around the rollers 6 and 7; and a platen 15 provided to a position where the platen 15 faces the four inkjet heads 1 in a region surrounded by the conveyor belt 8.

A conveyor motor 19 (see FIG. 8) rotates the belt roller 6 clockwise, causing the conveyor belt 8 to rotate clockwise. Thus, the conveyor belt 8 conveys the sheet P to the sheet discharge tray 12 while retaining the sheet P appressed to the adhesive outer circumferential surface of the conveyor belt 8.

The four inkjet heads 1 are aligned in the conveyance direction of the sheet P, and are fixed to a position where the inkjet heads 1 face the conveyance path. In short, the inkjet printer 101 is a line printer. Each of the four inkjet heads 1 includes a head main body 2 at a lower end. The head main body 2 has a rectangular parallelepiped-shape which is longer in a direction perpendicular to the conveyance direction. A bottom surface of the head main body 2 is an ejection surface 2*a* facing a conveyor surface of the conveyor belt 8. The conveyor surface is the upper side of the outer circumferential surface of the conveyor belt 8. While the sheet P conveyed by the conveyor belt 8 is sequentially passing through under the four head main bodies 2, ink droplets of the respective colors are ejected from the ink ejection faces 2*a* towards an upper surface of the sheet P which is a print surface. Thus, an intended color image is formed on the sheet P. The series of operations including sheet feeding, image formation, and sheet discharging are executed by a control unit 16 in sync with one another.

Figure 2:
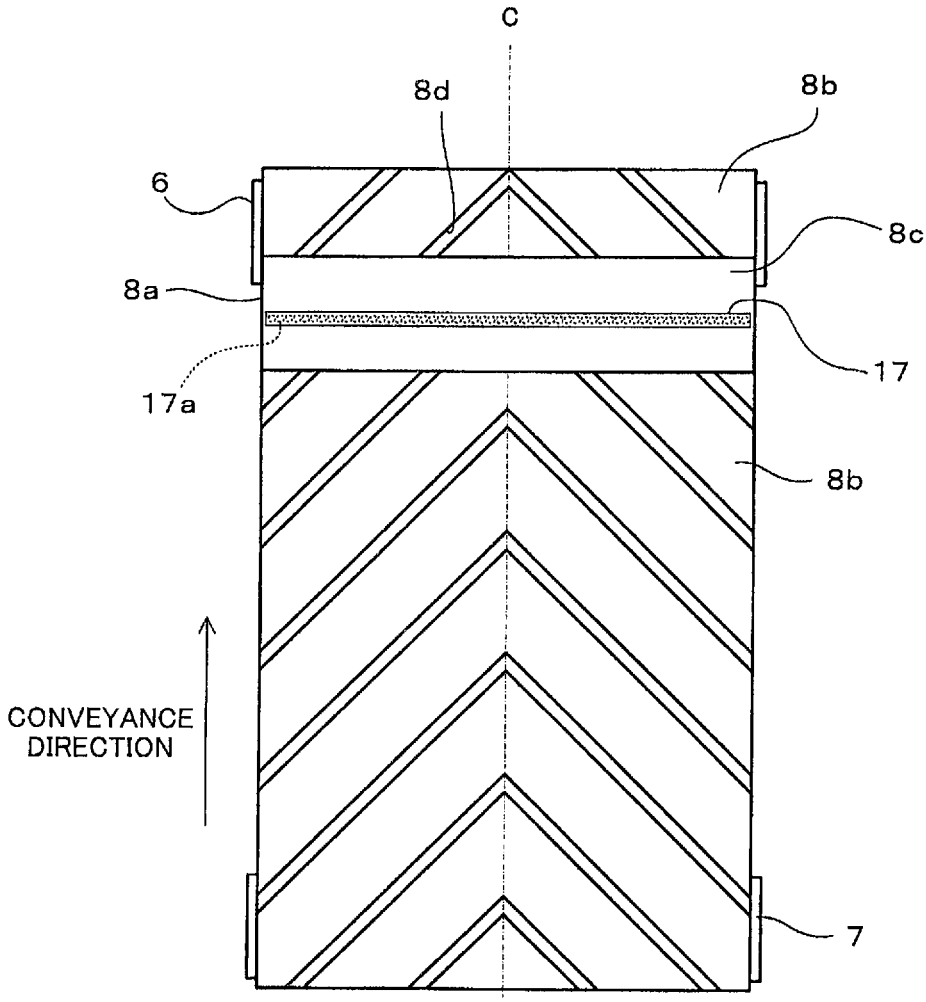
FIG. 2 is a plan view of the conveyor belt of FIG. 1.
Figure 3A:
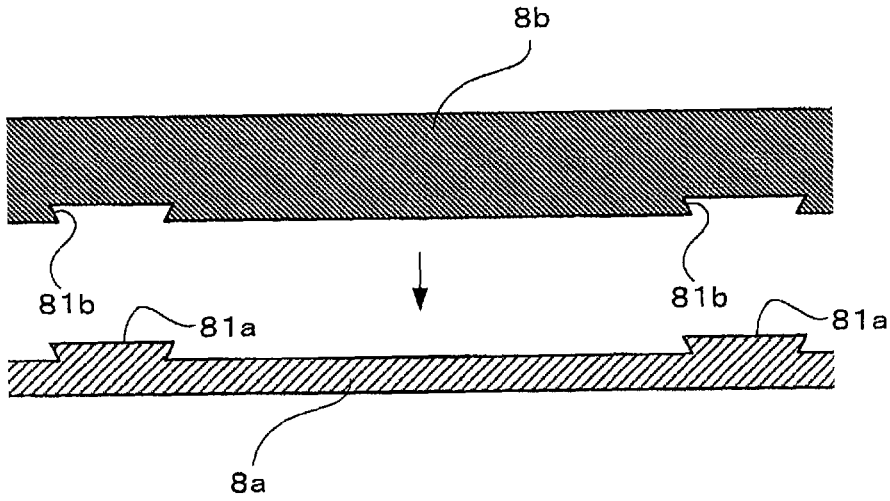
FIG. 3A and FIG. 3B are partial cross sectional views of the conveyor belt of FIG. 1 along a circumferential direction.
Figure 3B:
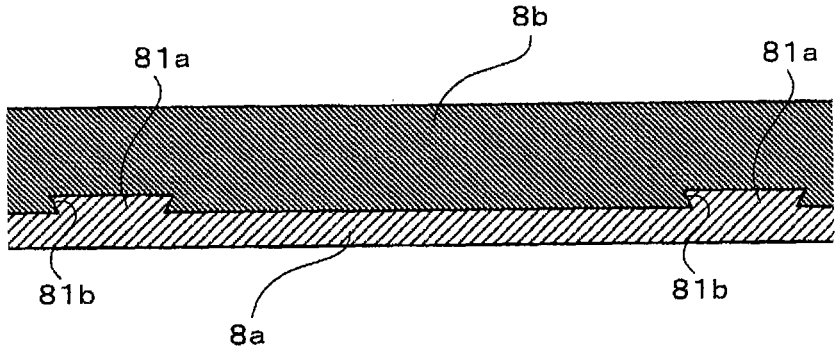
Figure 4:
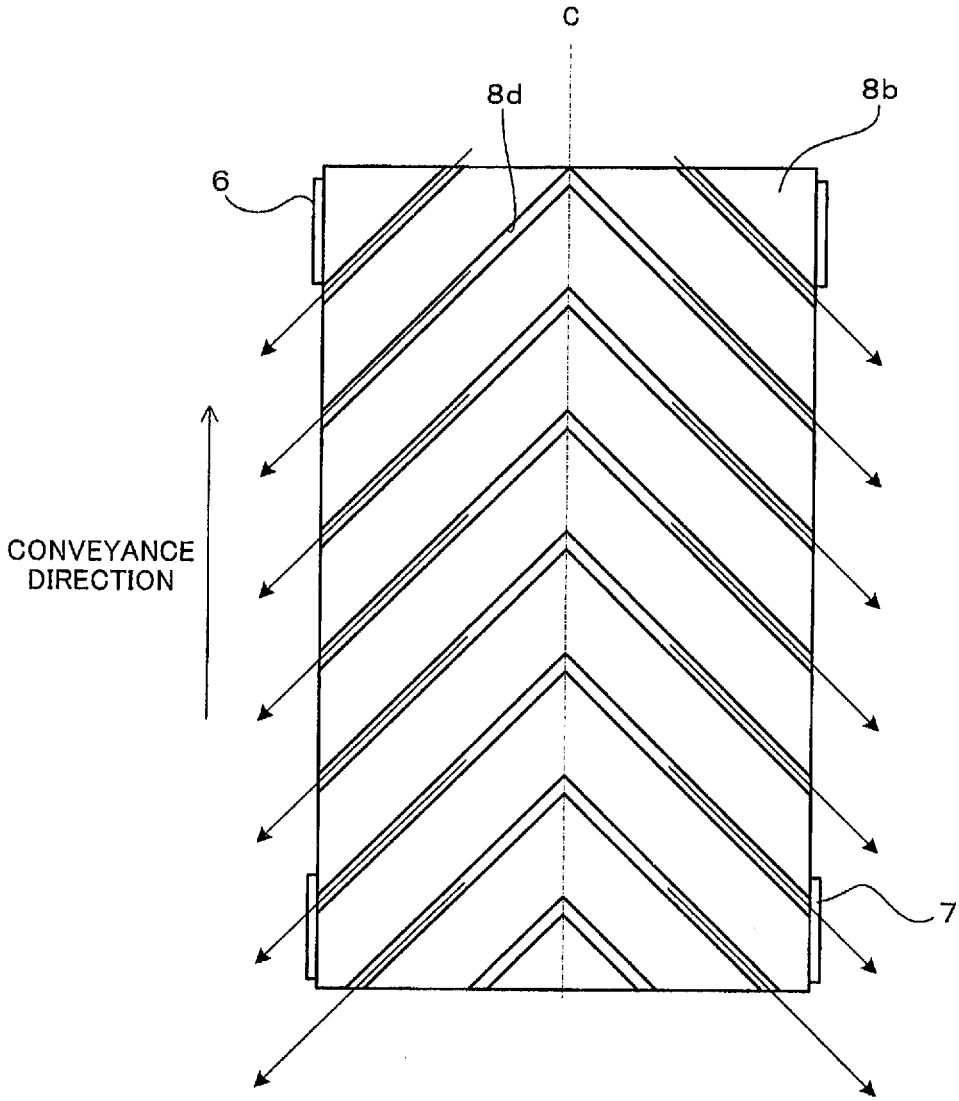
FIG. 4 is a plan view of the conveyor belt of FIG. 2 in running.

The following describes the conveyor belt 8 in detail with further reference to FIGS. 2 to 4. As illustrated in FIG. 1 and FIG. 2, the conveyor belt 8 includes a base 8*a* and two detachable plates 8*b*. The base 8*a* is tube-shaped; i.e., endless. Each of the detachable plates 8*b* has a rectangular shape longer in the conveyance direction of the sheet P, and has the same width as the base 8*a*. Each detachable plate 8*b* is detachably attached to the external surface of the base 8*a*. Each detachable plate 8*b* is made of a flexible material. At least an outer surface of each detachable plate 8*b* has adhesiveness. Further in the embodiment, each detachable plate 8*b* is longer than the sheet P in the conveyance direction. The base 8*a* and the two detachable plates 8*b* form a circumferential wall of the conveyor 13.

Each of the two detachable plates 8*b* is attached to the external surface of the base 8*a* so that the longitudinal direction of the detachable plate 8*b* conforms to the circumferential direction of the base 8*a*. That is, to the external surface of the base 8*a*, two detachable plates 8*b* are attached so as to be aligned in the circumferential direction of the base 8*a*. The two detachable plates 8*b* are not in contact with one another, that is, the two detachable plates 8*b* are apart from one another. Each of two regions on the external surface of the base 8*a* exposed between the detachable plates 8*b* is hereinafter referred to as an ejection target region 8*c*. The lengths of the two ejection target regions 8*c* in the circumferential direction of the base 8*c* are the same.

FIG. 3A illustrates a state where the detachable plate 8*b* is detached from the base 8*a*. FIG. 3B illustrates a state where the detachable plate 8*b* is attached to the base 8*a*. On the external surface of the base 8*a* are a plurality of protrusion 81*a* protruded towards the detachable plate 8*b*. Each of the protrusions 81*a* extends in the width direction of the conveyor belt 8. The protrusions 81*a* are formed throughout the entire length of the conveyor belt 8. The protrusions 81*a* are formed in the circumferential direction of the base 8*a*, equally spaced from one another. The width of each protrusion 81*a* is wider at a part closer to the leading end of the protrusion 81*a* than a part further from the leading end. That is, the closer to the leading end, the larger a cross-section area of the protrusion 81*a* parallel to the external surface of the base 8*a*. The protrusions 81*a* are formed only within an area of the external surface of the base 8*a* covered with the detachable plate 8*b*.

Meanwhile, on an inner surface of the detachable plate 8*b* (a surface facing the base 8*a*) are a plurality of recesses 81*b*. Each of the recesses 81*b* extends in the width direction of the conveyor belt 8. The recesses 81*b* are formed throughout the entire length of the conveyor belt 8. The recesses 81*b* are formed in the longitudinal direction of the detachable plate 8*b*, equally spaced from one another at the same interval as the interval between the protrusions 81*a* of the base 8*a*. The width of each recess 81*b* is wider at a part closer to the bottom surface of the recess 81*b* than a part further from the bottom surface of the recess 81*b*. That is, the closer to the bottom surface of the recess 81*b*, the larger a cross-section area of the recess 81*b* parallel to the outer surface of the detachable plate 8*b*.

When the detachable plate 8*b* is appressed to the base 8*a* while matching positions of a protrusion 81*b* and a recess 81*b*, the circumference of the recess 81*b* is elastically deformed, causing the protrusion 81*a* to be pushed to fit into the recess 81*b*. Thus, the detachable plate 8*b* is attached to the external surface of the base 8*a*. To the contrary, when the detachable plate 8*b* is pulled outwardly when the protrusion 8la is fitted into the recess 81*b*, the circumference of the recess 81*b* is elastically deformed, causing the protrusion 81*a* to separate from the recess 81. Thus, the detachable plate 8*b* detaches from the base 8*a*.

Alternatively, recesses and protrusions may be formed on the base 8*a* and the detachable plate 8*b*, respectively. Or, both recesses and protrusions may be formed on the base 8*a* and the detachable plate 8*b*. In the examples illustrated in FIG. 3A and FIG. 3B, the lengths of a protrusion 81*a* and a recess 81*b* in the circumferential direction of the base 8*a* are shorter than the lengths of the protrusion 81*a* and the recess 81*b* in the width direction of the base 8*a*. It is preferable in any alternative embodiment that the lengths of a protrusion and a recess in the circumferential direction of the base 8*a* are shorter than the lengths of the protrusion and the recess in the width direction of the base 8*a*. This increases the detachability of the detachable plate 8*b*, as well as restrains vibration or unevenness in speed which is likely to occur while the conveyance belt 8 is running.

Formed on the outer surface of each of the detachable plates 8*b* is an adhesive layer which realizes adhesiveness on the outer surface of each detachable plate 8*b*. The adhesive layer is made of silicone resin, for example. Further, brightness of the outer surface of each of the detachable plate 8*b* is higher than that of any color of ink ejected from the four inkjet heads 1. Thus, a user is able to precisely recognize a level of contamination caused by ink on the outer surfaces of the detachable plates 8*b*.

As illustrated in FIG. 2, on the outer surface of each detachable plate 8*b* are a plurality of grooves 8*d*. Each of the grooves 8*d* is slanted with respect to the conveyance direction of the sheet P, so that each of the grooves 8*d* extends outwardly from a center C of the width direction of the detachable plate 8*b*, towards upstream in the conveyance direction of the sheet P. This creates oblique airflow flowing outwardly from the center C along the grooves 8*d* when the conveyor belt 8 runs in the conveyance direction, as illustrated in FIG. 4. The airflow ejects dust to outside the conveyor belt 8. Thus, dust is less likely to move towards the inkjet heads 1. In addition, dust is less likely to adhere to a surface of the detachable plate 8*b*. This can restrain the adhesion of the detachable plates 8*b* from decreasing. Note that grooves 8*d* are formed on the detachable plates 8*b* in this embodiment; however, grooves 8*d* do not necessarily have to be formed.

Back to FIG. 1 and FIG. 2, provided immediately downstream of the four inkjet heads 1 is an image sensor 17. The image sensor 17 is a line sensor including a plurality of lenses 17*a* and a plurality of not illustrated light sensing elements. The lenses 17*a* are aligned in the width direction of the conveyor belt 8. The light sensing elements receive light from each of the lenses 17*a* and transform the received light into an electric signal. As described below, the image sensor 17 functions as an ejection status sensor. The image sensor 17 senses an ink droplet ejection failure in relation to an ejection opening 108 which is an opening of a nozzle. Specifically, the image sensor 17 senses the ejection failure based on the condition of ink dots formed in the ejection target region 8*c* on the conveyor belt 8. A CCD (Charge Coupled Device) image sensor, for example, may be adopted as the image sensor 17.

Below the conveyor belt 8 is a cleaning mechanism 18 for cleaning the ejection target region 8*c*. The cleaning mechanism 18 includes a cleaning liquid retainer 18*a* and a blade 18*b*. The cleaning liquid retainer 18*a* is made of sponge which retains cleaning liquid supplied from a not illustrated cleaning liquid tank. The blade 18*b* is made of an elastic material such as rubber or resin, and has a rectangular shape. The cleaning liquid retainer 18*a* and the blade 18*b* are adjacent to each other in the width direction of the conveyor belt 8 (see FIG. 9B). The cleaning liquid retainer 18*a* and the blade 18*b* are slightly longer than the ejection target region 8*c* in the conveyance direction. Further, the cleaning mechanism 18 is enabled to move by a not illustrated moving mechanism, in up/down direction and in the width direction of the conveyor belt 8. A specific operation of the cleaning mechanism 18 is detailed later.

Figure 5:
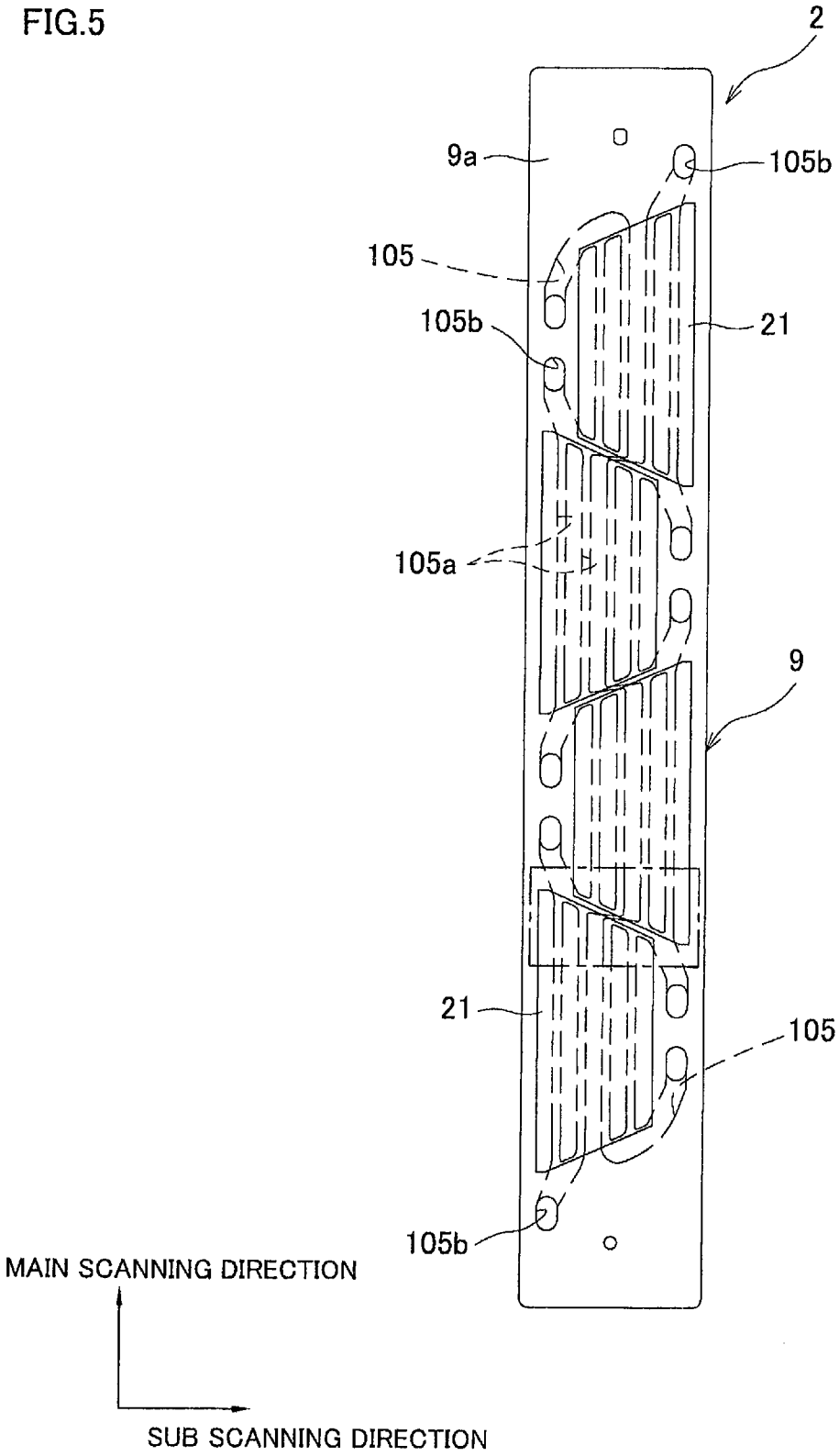
FIG. 5 is a plan view of the head main body drawn in FIG. 1.
Figure 6:
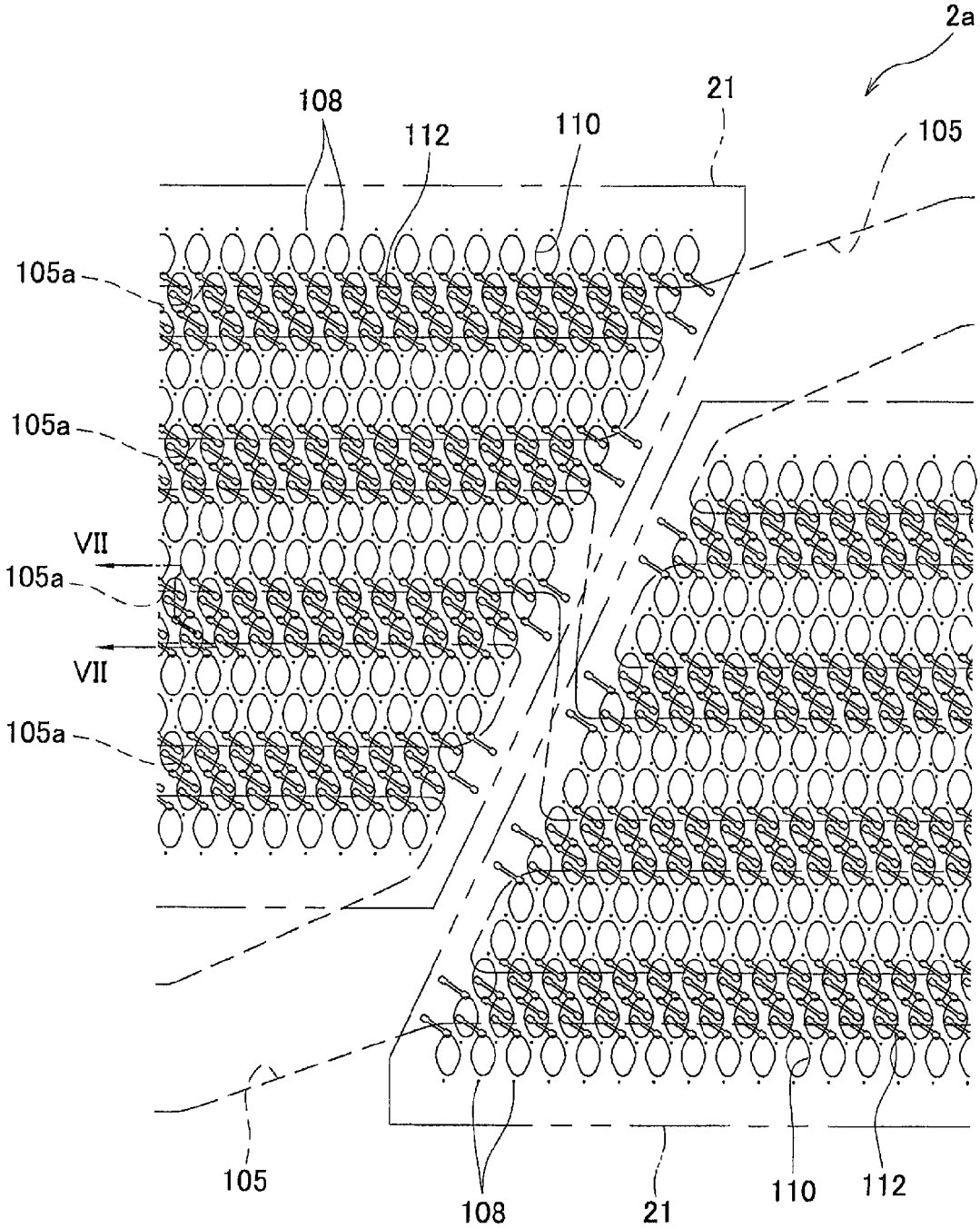
FIG. 6 is a magnified view of the areas of FIG. 5 surrounded with alternate long and short dashed lines.
Figure 7:
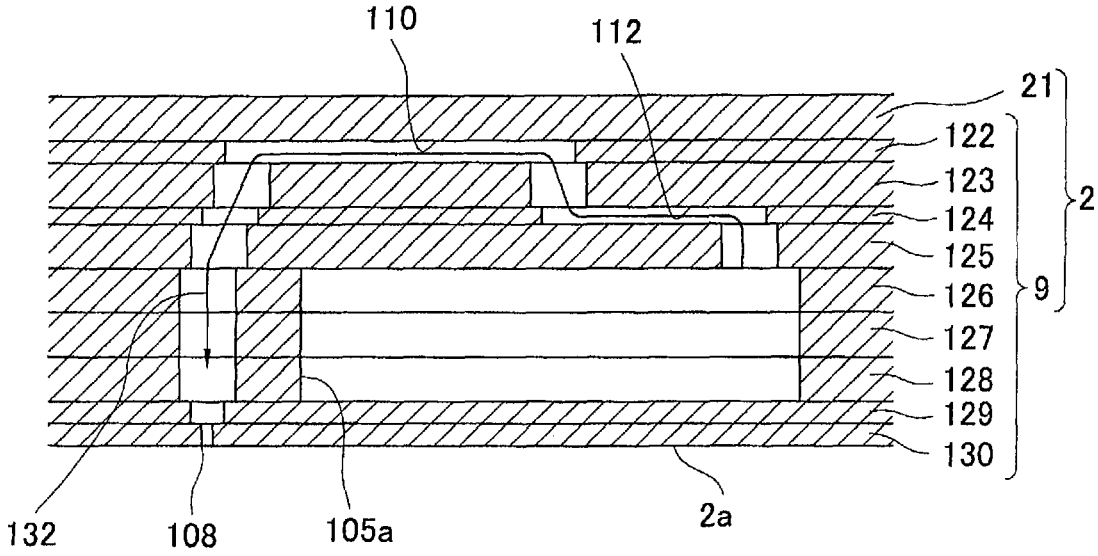
FIG. 7 is a cross-sectional view taken along the VII-VII line in FIG. 6.

The following describes the head main body 2 with reference to FIGS. 5 to 7. FIG. 5 is a plan view of the head main body 2. FIG. 6 is a magnified view of the areas of FIG. 5 surrounded with alternate long and short dashed lines. Note that in order to make FIG. 6 comprehensible, an actuator unit 21 is drawn with a chain double-dashed line although it is supposed to be drawn with a solid line. Further in FIG. 6, ejection openings 108, a pressure chamber 4, and an aperture 12 are drawn with solid lines, although they are supposed to be drawn with dashed lines. FIG. 7 is a cross-sectional view taken along the VII-VII line in FIG. 6.

Assembled into the head main body 2 are a not-illustrated reservoir unit which supplies ink, a driver IC 51 (see FIG. 8) which generates a drive signal for driving the actuator unit 21, or the like. Thus, the inkjet head 1 is formed.

The head main body 2 includes a passage unit 9, and four actuator units 21 fixed on an upper surface 9*a* of the passage unit 9, as illustrated in FIG. 5. Each of the actuator units 21 includes a plurality of individual electrodes provided so as to face a plurality of pressure chambers 110 formed in the passage unit 9. The actuator 21 has a function of selectively supplying ejection energy to the ink in the pressure chambers 110.

A total of ten ink supply openings 105*b* are open on the upper surface 9*a* of the passage unit 9. Inside the passage unit 9 are a plurality of manifold passages 105 each having an ink supply opening 105*b* at one end, and a plurality of sub manifold passages 105*a* branched off from a manifold passage 105. As illustrated in FIG. 4, a lower surface of the passage unit 9 is an ejection surface 2*a* where a plurality of ejection openings 108 are provided, each of which ejection openings 108 serves as an opening of a nozzle. The ejection openings 108 are aligned in a matrix manner; i.e., regularly and two dimensionally. On the upper surface of the passage unit 9 are a plurality of pressure chambers 110 aligned in a matrix manner.

As illustrated in FIG. 7, the passage unit 9 is formed with plates 122 to 130 made of a metal such as stainless steel. Each of the plates 122 to 130 has a rectangular flat surface longer in a main scanning direction. Aligning and laminating these plates 122 to 130 connects through holes formed on plates 122 to 130, thereby forming a plurality of individual ink passages 132 in the passage unit 9, each running from a manifold passage 105 to an ejection opening 108, through a sub manifold passage 105*a* and a pressure chamber 110.

The following describes ink flow in the passage unit 9. Ink supplied from a reservoir unit into the passage unit 9 via an ink supply opening 105*b* is divided into the sub manifold passages 105*a* from the manifold passage 105. The ink inside each of the sub manifold passages 105*a* flows into each ink passage 132. The ink then reaches an ejection opening 108 via an aperture 112 functioning as a throttle, and a pressure chamber 110.

The following describes the actuator unit 21. As illustrated in FIG. 3, the four actuator units 21 has a flat trapezoidal shape. These actuator units 21 are placed in zigzag so as to avoid the ink supply openings 105*b*. Further, a pair of parallel sides of each of the actuator units 21 extend in the longitudinal direction of the passage unit 9. Hypotenuses of adjacent actuator units 21 overlap with one another in the width direction of the passage unit 9; i.e., a sub scanning direction.

The actuator unit 21 includes a plurality of actuators each facing a pressure chamber 110. Each of the actuators selectively supplies ejection energy to the ink inside the pressure chamber 110 for each printing cycle. Specifically, the actuator unit 21 is formed with three piezoelectric sheets made of a lead zirconate titanate (PZT) ceramic material having ferroelectricity. Each of the piezoelectric sheets is a continuous plate having a size equal to or larger than a plurality of pressure chambers 110. In each of the positions facing the pressure chambers 110 on the top piezoelectric sheet is an individual electrode. Between the top piezoelectric sheet and another piezoelectric sheet underneath the top piezoelectric sheet is a common electrode intervening the entire surface of the sheet.

The common electrode is evenly retained at a ground potential in regions of the common electrode corresponding to all the pressure chambers 110. Meanwhile, a drive signal from the driver IC 51 is selectively input into the individual electrodes. Thus, a part of the actuator unit 21 sandwiched by an individual electrode and a pressure chamber 110 functions as an individual actuator. In other words, the four actuator units 21 includes as many actuators as there are pressure chambers 110.

Figure 8:
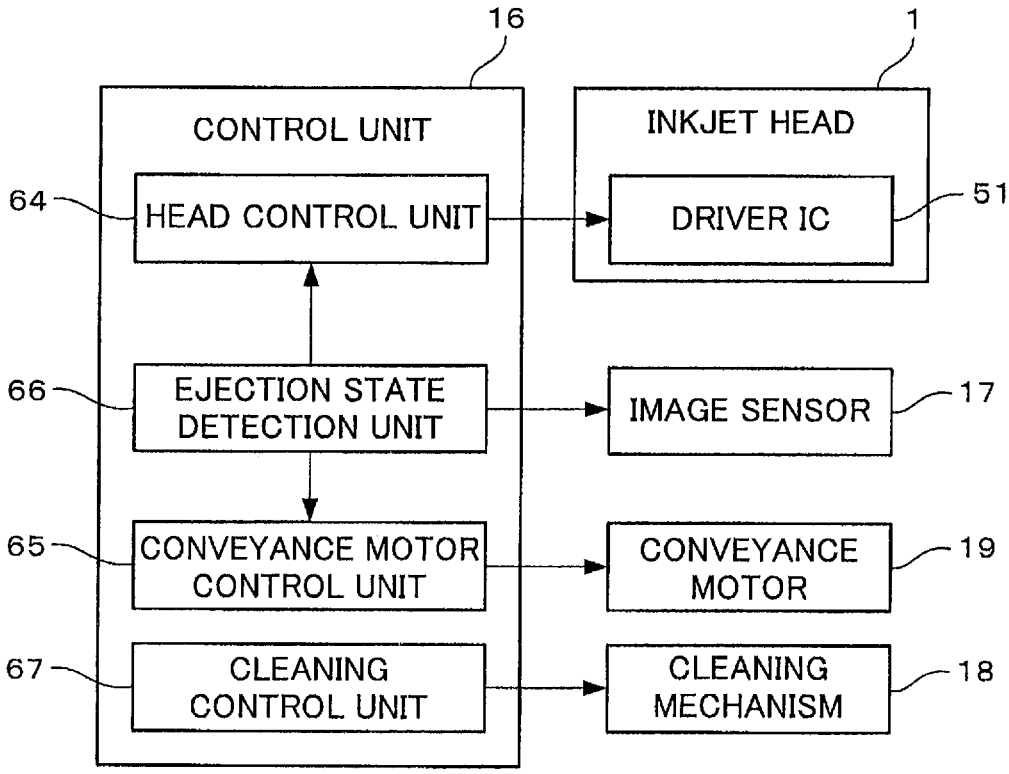
FIG. 8 is a block diagram of the control unit of FIG. 1.

The following describes the control unit 16 with reference to FIG. 8. In order to simplify the description in FIG. 8, it is drawn as if only one of the inkjet heads 1 is connected to the control unit 16. As illustrated in FIG. 8, the control unit 16 includes a head control unit 64, a conveyor motor control unit 65, an ejection status detection unit 66, and a cleaning control unit 67.

By outputting a control signal to the driver IC 51, the head control unit 64 controls timing of ejection of an ink droplet from the ejection openings 108 so as to form an image on the sheet P being conveyed by the conveyor 13. The conveyor motor control unit 65 controls a drive speed of the conveyor motor 19 to cause the conveyor belt 8 to run at a predetermined speed.

The ejection status detection unit 66 detects an ink droplet ejection status in relation to every ejection opening 108 of an inkjet head 1, in an ejection test of the inkjet head 1. Specifically, the ejection status detection unit 66 first causes the conveyor belt 8 to run, via the conveyor motor control unit 65. When the ejection target region 8*c* of the conveyor belt 8 serving as a detection target faces the ejection surface of the inkjet head 1, the ejection status detection unit 66 causes, via the head control unit 64, all the nozzles on the ejection surface 2*a* to eject an ink droplet simultaneously or sequentially for a predetermined period of time. Thus, a plurality of ejected ink droplets land on the ejection target region 8*c*, forming a plurality of dots on the ejection target region 8*c*. A detection of whether the ejection target region 8*c* faces the ejection face 2*a* is made based on, for example, a signal output from an encoder coaxially provided with the roller 6, or timing when the image sensor 17 detects a position of the ejection target region 8*c*.

Then, when the ejection target region 8*c* of the conveyor belt 8 passes below the image sensor 17, the image sensor 17 reads out the condition of each dot formed on the ejection target region 8*c*. In this embodiment, "condition of a dot" means at least one of presence/absence of a dot, a size of a dot, and a position where a dot is formed. Based on a result of the reading by the image sensor 17, the ejection status detection unit 66 detects an ink droplet ejection status in relation to each ejection opening 108. That is, when a dot to be formed is not formed in the ejection target region 8*c*, the ejection status detection unit 66 detects an ejection disability in relation to the ejection opening 108 corresponding to the dot. Further, when a dot is formed in a position different from a correct position, or when an area of a dot formed is smaller than a predetermined value, the ejection status detection unit 66 detects an ejection failure in relation to the ejection opening 108.

When such an ejection error (ejection disability or ejection failure) is detected, the ejection error is informed to a not-illustrated control panel or a superordinate computer. Then, when the ejection target region 8*c* reaches a cleaning position, the ejection status detection unit 66 stops the conveyor belt 8 via the conveyor motor control unit 65, so as to enable the cleaning mechanism 18 to clean the ejection target region 8*c*. The cleaning position is a position where the ejection target region 8*c* possibly faces the cleaning mechanism 18. Note that when an ejection error is detected, the error-detected ejection opening 108 may be recovered through a user-instructed or automated purge operation in which a large amount of ink is ejected from all the ejection openings 108 to the ejection target region 8*c*.

Figure 9A:
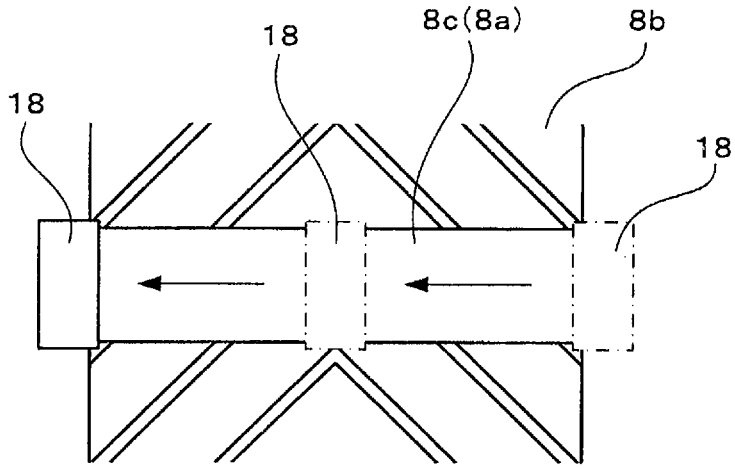
FIG. 9A and FIG. 9B illustrate an operation of the cleaning mechanism of FIG. 1.
Figure 9B:
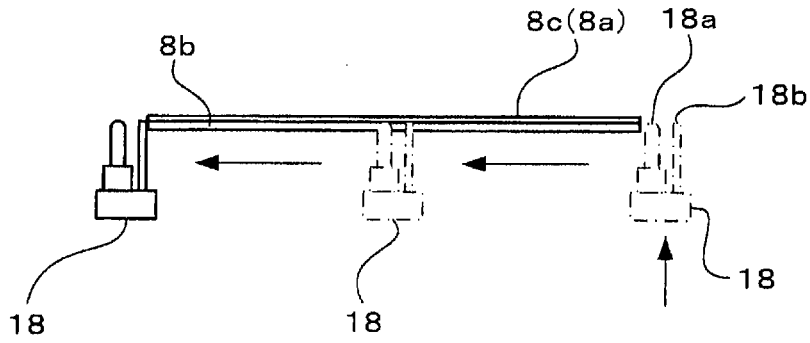

The cleaning control unit 67 controls operations of the cleaning mechanism 18. The following describes in detail an operation of the cleaning mechanism 18 with reference to FIG. 9A and FIG. 9B. FIG. 9A is a bottom view of an operation of the cleaning mechanism 18. FIG. 9B is a side view of the operation of the cleaning mechanism 18. As illustrated in FIG. 9A and FIG. 9B, the cleaning mechanism 18 has the cleaning liquid retainer 18*a* between the blade 18 at a stand-by position and the conveyor belt 8. Then, when the ejection target region 8*c* reaches the cleaning position and thus the conveyor belt 8 stops, the cleaning control unit 67 causes the cleaning mechanism 18 to rise so that the leading ends of the cleaning liquid retainer 18*a* and the blade 18*b* come to be at the same height as the ejection target region 8*c*. Alternatively, the cleaning control unit 67 causes the cleaning mechanism 18 to rise so that each leading end of the cleaning mechanism 18 comes to be slightly higher than the ejection target region 8*c*. Then, the cleaning control unit 67 causes the cleaning mechanism 18 to move to the left in FIG. 9A and FIG. 9B (cleaning direction), so that the cleaning mechanism 18 traverses the ejection target region 8*c* in the width direction of the conveyor belt 8. Along with the movement of the cleaning mechanism 18, the cleaning liquid retainer 18*a* applies cleaning liquid to the ejection target region 8*c*, and the blade 18*b* removes the cleaning liquid applied by the cleaning liquid retainer 18*a*. Thus, the ejection target region 8*c* is certainly cleaned. When cleaning of the ejection target region 8*c* is complete, the cleaning control unit 67 brings down the cleaning mechanism 18, and moves the same to the right in FIG. 9A and FIG. 9B thereafter. Afterwards, the cleaning control unit 67 causes the cleaning mechanism 18 to return to the stand-by position. Then, the ejection status detection unit 66 causes the conveyor belt 8 to resume running.

Figure 10:
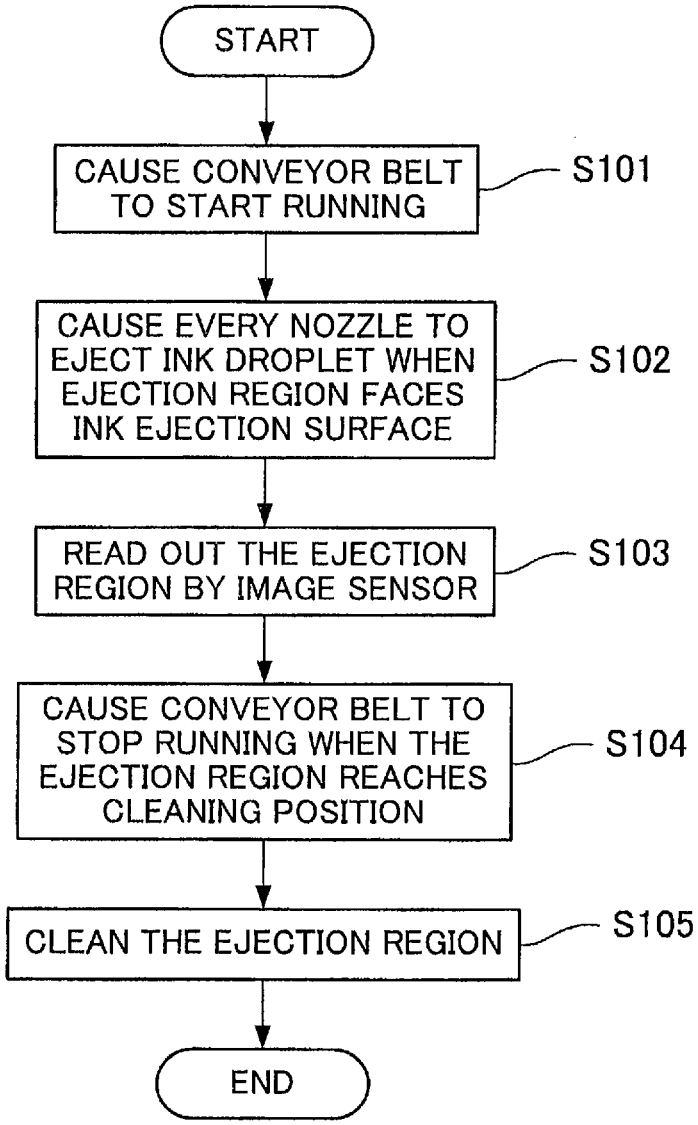
FIG. 10 is a flow chart illustrating an operation of an ejection test of the inkjet head of FIG. 1.

The following describes an operation of the inkjet printer 101 during the ejection test of the inkjet head 1, with reference to FIG. 10. The ejection test of the inkjet head 1 begins, for example, when an instruction is given by the user, upon powering on the inkjet printer 101; after a predetermined period of time after the inkjet printer 101 is powered on: or before printing on a sheet P begins. As illustrated in FIG. 10, when the ejection test for the inkjet head 1 begins, the operation moves to step S101 (hereinafter, referred to as S101, and the same holds for other steps), and the ejection status detection unit 66 causes the conveyor belt 8 to run via the conveyor motor control unit 65. Then, the process moves to S102, and when the ejection target region 8*c* of the conveyor belt 8 faces the ejection surface 2*a* of the detection target inkjet head 1, the ejection status detection unit 66 causes all the nozzles on the ejection surface 2*a* to sequentially or simultaneously eject an ink droplet, via the head control unit 64. Thus, the plurality of ink droplets ejected land on the ejection target region 8*c* to form a plurality of dots on the ejection target region 8*c*.

Further, the process moves to S103, and when the ejection target region 8*c* passes below the image sensor 17, the ejection status detection unit 66 reads out with the image sensor 17 the condition of each dot formed on the ejection target region 8*c*. Based on a result of the reading by the image sensor 17, the ejection status detection unit 66 detects an ink droplet ejection status in relation to each ejection opening 108. When an ejection error is detected in this process, a not-illustrated control panel or a superordinate computer is informed with the error. Then, the process moves to S104, and when the ejection target region 8*c* reaches the cleaning position, the ejection status detection unit 66 causes the conveyor belt 8 to stop running via the conveyor motor control unit 65.

When the ejection target region 8*c* reaches the cleaning position, the process moves to S105, and the cleaning control unit 67 causes the cleaning mechanism 18 to operate to clean the ejection target region 8*c*. After the cleaning of the ejection target region 8*c* is complete, the cleaning control unit 67 causes the cleaning mechanism 18 to return to the stand-by position. By executing the above operations to each of the four inkjet heads 1, ejection tests of four inkjet heads 1 is performed. Note that an ejection test is done for each inkjet head 1 in this embodiment. However, an ejection test can be done simultaneously to the four inkjet heads 1 if an ejection region has a size large enough for landing thereon all the plurality of ink droplets ejected from the plurality of ejection openings 108 of the four inkjet heads 1. Further, an ejection test may be performed only to some of the ejection openings 108, by causing the some of the ejection openings 108 out of all the ejection openings to eject an ink droplet to the ejection target region 8*c*.

In the above described embodiment, the detachable plate 8*b* is detachably attached to the base 8*a* by fitting the protrusions 81*a* on the base 8*a* into the recesses 81*b* of the detachable plate 8*b*. This enables the detachable plate 8*b* to be easily attached/detached to/from the base 8*a*. Thus, the detachable plate 8*b* is easily replaceable.

Further, the conveyor 13 including the conveyor belt 8 allows to easily change the shape of the area of the conveyor 13 surrounded by the conveyor belt 8. This helps to reduce the size of the inkjet printer 101.

In addition, an adhesive layer provided on a surface of the detachable plate 8*b* surely retains the sheet P placed thereon.

Further, brightness of the outer surface of the detachable plate 8*b* is higher than that of any of the ink ejected from the four inkjet heads 1. This enables a user to precisely recognize a level of contamination caused by ink on the surface of the detachable plate 8*b*. Thus, the detachable plate 8*b* can be replaced at an appropriate time.

Further, it is possible to replace only one detachable plate 8*b* deteriorated or heavily contaminated, out of the two detachable plates 8*b* attached to the external surface of the base 8*a*. Doing so reduces the running cost.

Further, the two detachable plates 8*b* are attached to the external surface of the base 8*a* so as to form ejection target regions 8*c* partly exposing the base 8*a*. Thus, ejection target regions 8*c* are easily formed. Further, the ejection openings 108 are recovered by ejecting an ink droplet to an ejection target region 8*c*. Further, side surfaces of detachable plates 8*b* are exposed. Thus, a detachable plate 8*b* is more easily replaceable.

In addition, an image sensor 17 is provided, which reads out the condition of a dot formed in the ejection target region 8*c*. This enables an ejection test of the ejection openings 108 on the dot.

Further, the cleaning mechanism 18 includes the cleaning liquid retainer 18*a* which applies cleaning liquid to the ejection target region 8*c*, and the blade 18*b* which removes the cleaning liquid applied to the ejection target region 8*c*. This allows the ejection target region 8*c* to be certainly cleaned.

Further, a plurality of grooves 8*d* are formed on the surface of each of the detachable plates 8*b*, which creates airflow flowing outwardly from the center C when the conveyor belt 8 runs in the conveyance direction. This helps dust to be ejected outside conveyor belt 8, preventing dust from adhering to the surface of the detachable plate. This can restrain the adhesion of the detachable plates 8*b* from decreasing.

Further, brightness of the ejection target region 8*c* on the external surface of the base 8*a* is higher than that of any of the ink ejected from the four inkjet heads 1. Thus, it is possible to precisely read out a dot formed on the ejection target surface 8*c* in an ejection test of the inkjet heads 1.

FIRST MODIFIED EXAMPLE

Figure 11A:
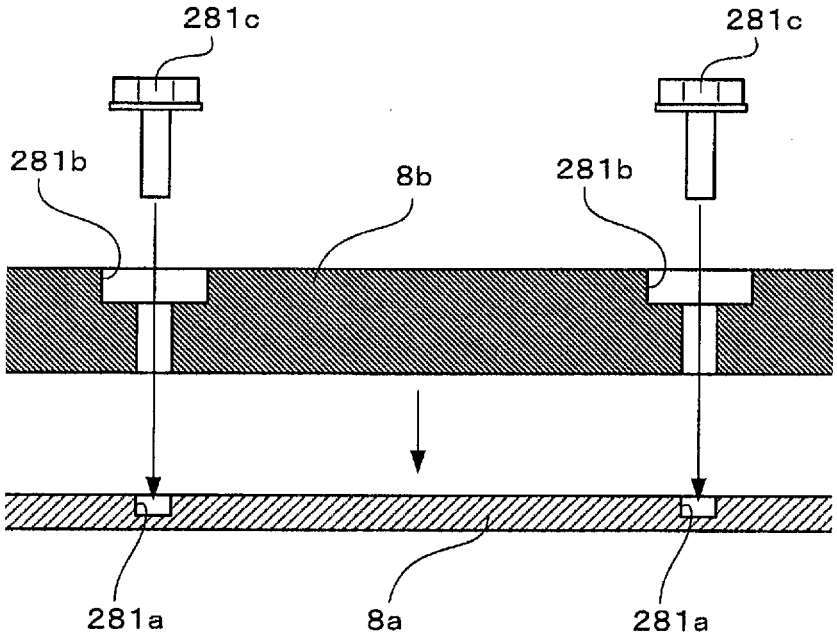
FIG. 11A and FIG. 11B are partial cross sectional views of a conveyor belt of the first modified example.
Figure 11B:
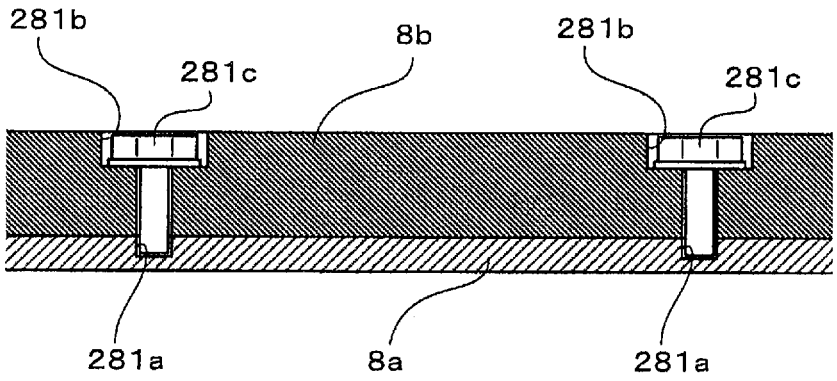

As illustrated in FIG. 11A, on the detachable plate 8*b* are through holes 281*b*. In each of the through holes 281*b*, a screw 281*c* serving as a fastening bolt is inserted. On a surface of the base 8*a* facing the detachable plate 8*b* are screw holes 281*a* in which the screws 281*c* fit, respectively. As illustrated in FIG. 11B, the detachable plate 8*b* is detachably attached to the base 8*a* with screws 281*c* which are inserted into the through holes 281*b*, respectively, and fits into the screw holes 281*a*, respectively. With this modified embodiment, the detachable plate 8*b* is securely attached to the base 8*a*.

SECOND MODIFIED EXAMPLE

Figure 12A:
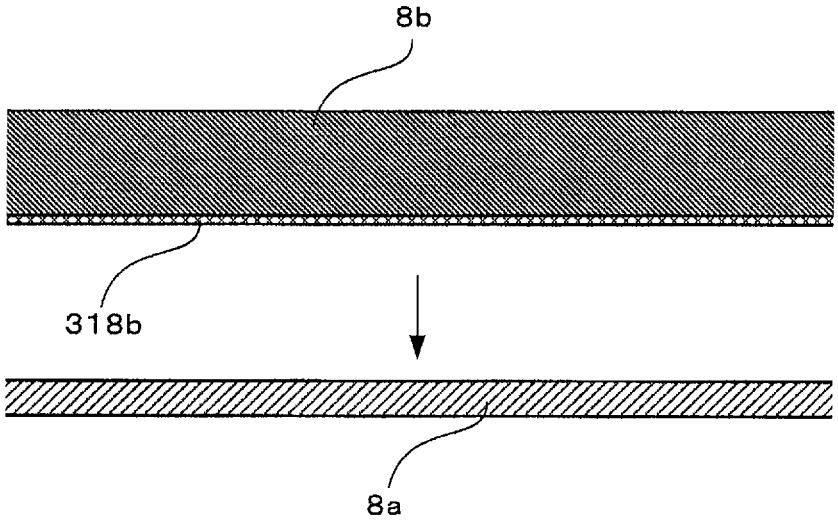
FIG. 12A and FIG. 12B are partial sectional views of a conveyor belt of the second modified example.
Figure 12B:
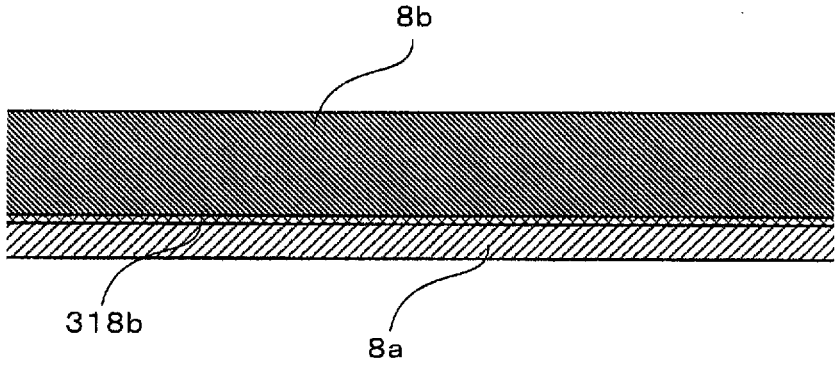

As illustrated in FIG. 12A, adhesive 318*b* is applied to a surface of the detachable plate 8*b* facing the base 8*a*. With the applied adhesive 318*b*, the detachable plate 8*b* is detachably attached to the base 8*a*, as illustrated in FIG. 12B. Note that the adhesive may be applied to the base 8*a*.

THIRD MODIFIED EXAMPLE

Figure 13:
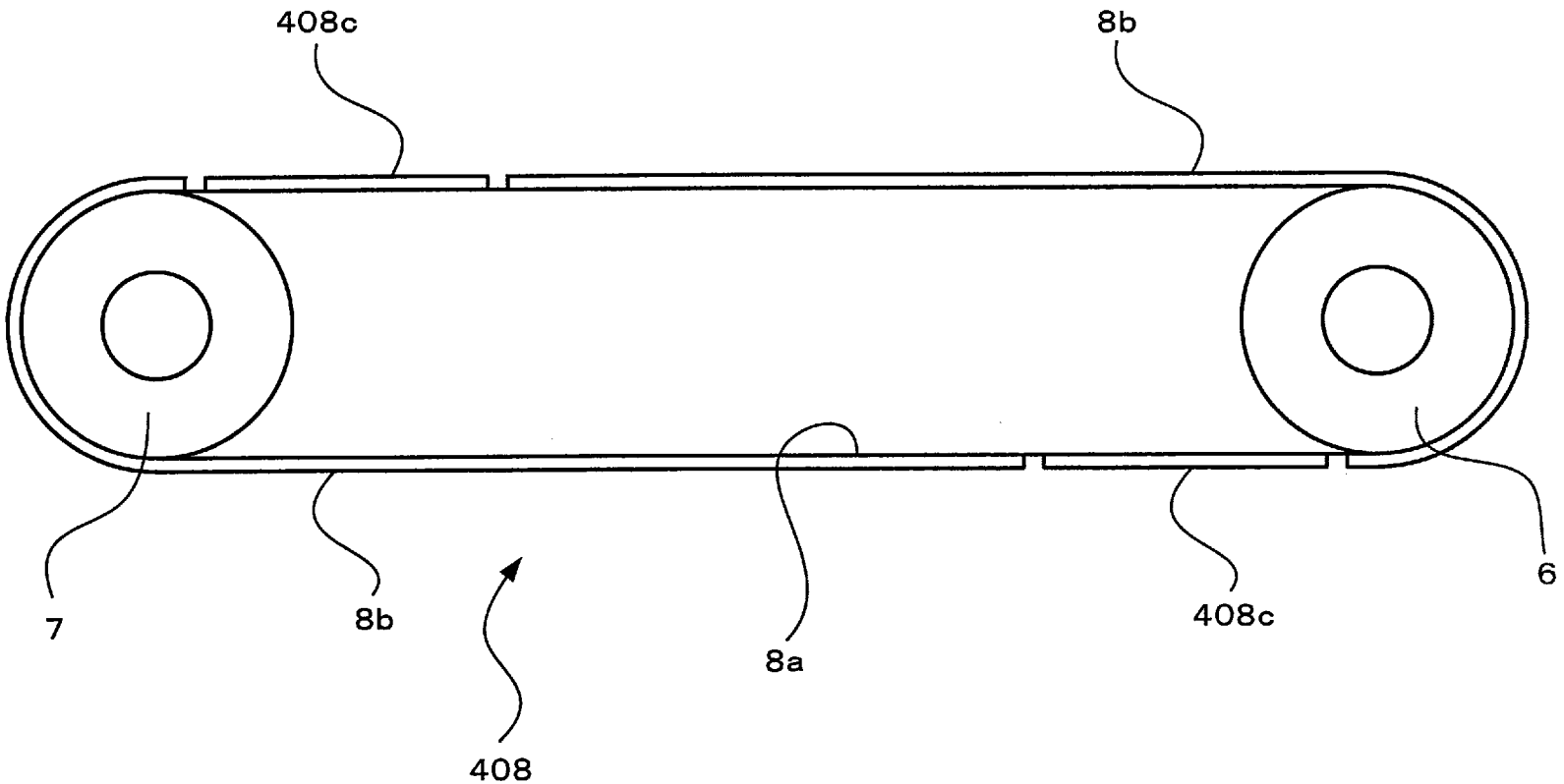
FIG. 13 is a side view of a conveyor belt provided to an inkjet printer of the third modified example.
Figure 14:
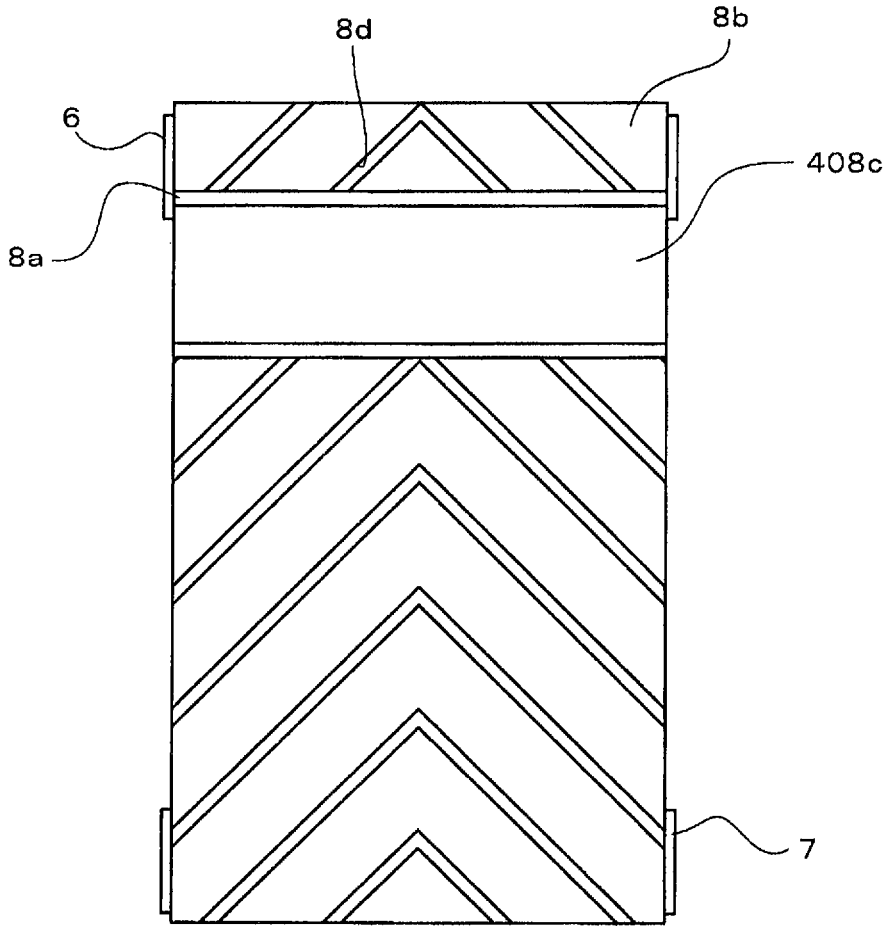
FIG. 14 is a plan view of the conveyor belt of FIG. 13.

The following describes the inkjet printer of a third modified embodiment, according to the present invention, with reference to FIG. 13 and FIG. 14. Note that the structure of the inkjet printer of this modified embodiment is practically the same as that of the above embodiment, other than a conveyance belt 408. Thus, the same symbols as the first embodiment are given to the members except for the conveyor belt 408, and the descriptions of those members are omitted. The following mainly describes the conveyor belt 208.

As illustrated in FIG. 13 and FIG. 14, the conveyor belt 408 includes a base 8*a* having a tube shape, and four detachable plates made of a flexible material, which are detachably attached to an external surface of the base 8*a*. The four detachable plates are distinguishable, by their size, into two types: two detachable plates 8*b* and two ejection target plates 408*c*. The two detachable plates 8*b* have the same dimension, and are longer in the conveyance direction. The two ejection target plates 408*c* have the same dimension, and are shorter in the conveyance direction. The base 8*a*, the two detachable plates 8*b*, and the two ejection target plates 408*c* form a circumferential wall of the belt conveyor.

Each of the two detachable plates 8*b* and each of the two ejection target plates 408*c* are alternately attached to the external surface of the base 8*a* in the circumferential direction of the base 8*a*, so that each plate 8*b* or 408*c* is apart from an adjacent plate 8*b* or 408*c* Alternatively, each of the two detachable plates 8*b* and each of the two ejection target plates 408 may be attached to the external surface of the base 8*a* so that each plate 8*b* or 408*c* is in contact with an adjacent plate 8*b* or 408*c*.

Like the detachable plate 8*b*, on a surface of each of the ejection target plates 408*c* facing the base 8*a* are a plurality of recesses 81*b*. Further, in this modified example, protrusions 81*a* are formed (i) within an area of the external surface of the base 8*a* covered with the two detachable plates 8*b*, and (ii) within an area of the external surface of the base 8*a* covered with the two ejection target plates 408*c* but not with the two detachable plates 8*b*. Further, the protrusions 81*a* formed on a surface of the base 8*a* facing the ejection target plate 408*c* respectively fit into the recesses 81*b*. Thus, the detachable plates 8*b* as well as the ejection target plates 408*c* are detachably attached to the external surface of the base 8*a*.

Each of the detachable plates 8*b* and each of the ejection target plates 408*c* adjacent to one another are placed so as to be apart from each other, exposing a part of the external surface of the base 8*a* therebetween. Thus, side surfaces of the detachable plates 8*b* and the ejection target plates 408*c* are exposed. Hence, a detachable plate 8*b* and an ejection target plate 408*c* are easily replaceable. Further, brightness of the outer surface of the ejection target plate 208*c* is higher than that of any of the ink ejected from the four inkjet heads 1. Further, surface roughness of the ejection target plate 408*c* is lower than that of the detachable plate 8*b*.

A procedure for an ejection test of the inkjet head 1 in this modified example is practically the same as that of the above embodiment, except that the ejection target region 8*c* of the above embodiment is replaced by the ejection target plate 408*c*. Thus, a description of the procedure is omitted.

In this modified example, two detachable plates 8*b* and the two ejection target plates 408*c* are detachably attached to the base 8*a*. Thus, the two detachable plates and the two ejection target plates 408*c* are easily detached from the base 8*a*. Thus, the two detachable plates 8*b* and the two ejection target plates 408*c* are easily replaceable.

Further, surface roughness of the ejection target plate 408*c* is lower than that of the detachable plate 8*b*. Thus, ink ejected to the ejection target plate 408*c* is easily removed.

Further, brightness of the outer surface of the detachable plate 8*b* is higher than that of any of the ink ejected from the four inkjet heads 1. Thus, a user is able to precisely recognize a level of contamination caused by ink on a surface of the detachable plate 8*b*. This allows the detachable plate 8*b* to be replaced at an appropriate time.

Further, brightness of the outer surface of the ejection target plate 408*c* is higher than that of any of the ink ejected from the four inkjet heads 1. Thus, it is possible to precisely read out a dot formed on the ejection target plate 408*c* in an ejection test of the inkjet heads 1. Further, a user is able to precisely recognize a level of contamination caused by ink on a surface of the ejection target plate 408*c*. This allows the ejection target plate 408*c* to be replaced at an appropriate time.

<Second Embodiment>

Figure 15:
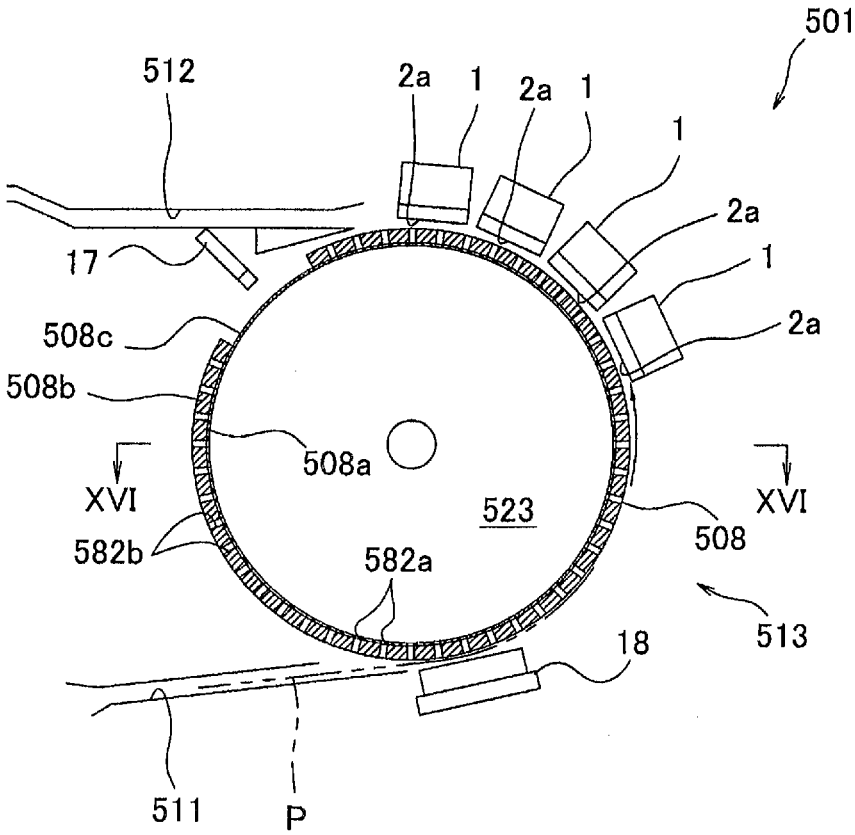
FIG. 15 is a schematic cross sectional view of a conveyor of the second embodiment of the present invention.
Figure 16:
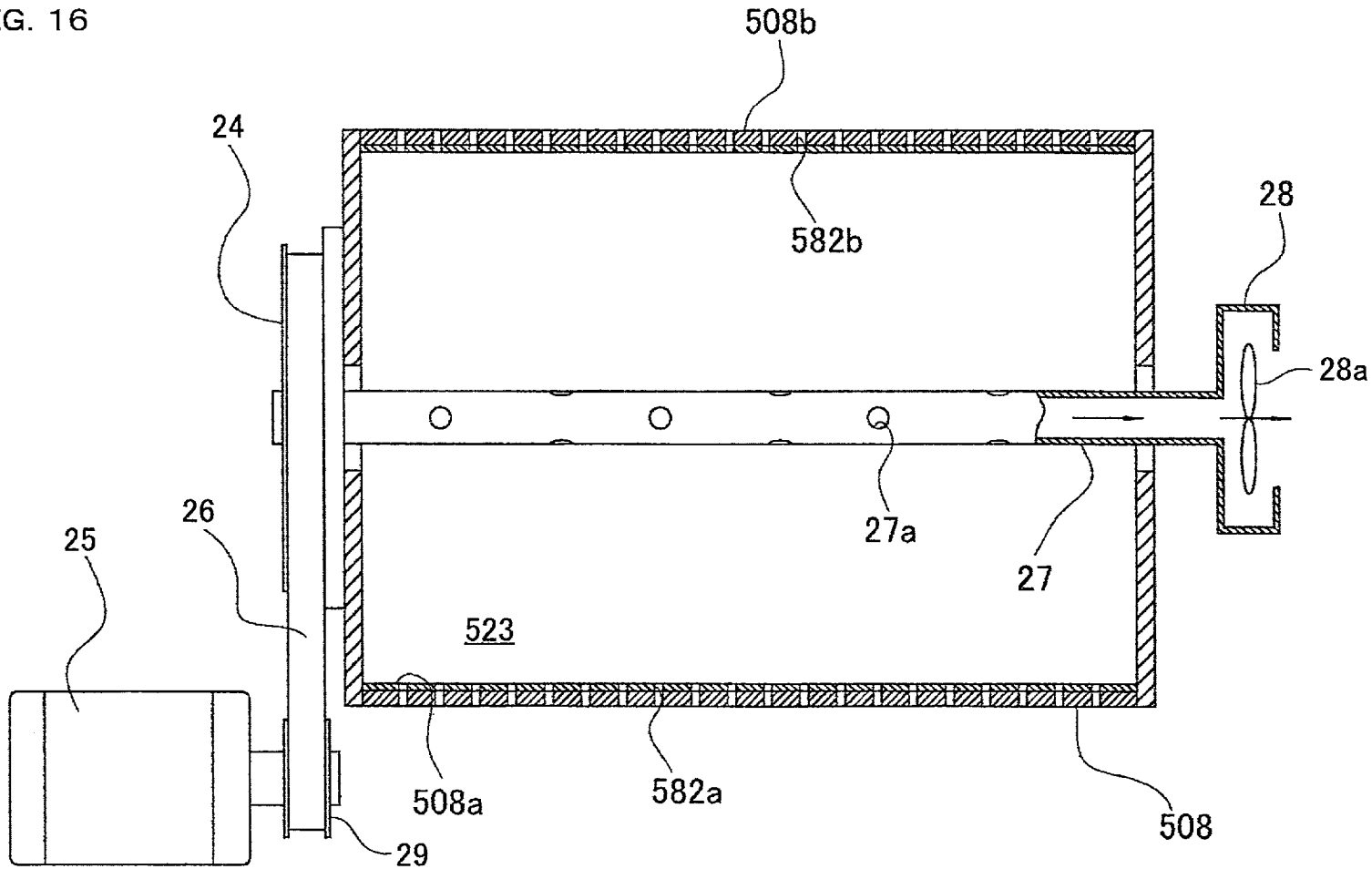
FIG. 16 is a cross-sectional view taken along the XVI-XVI line in FIG. 15.

The following describes an inkjet printer of a second embodiment of the present invention, with reference to FIG. 15 and FIG. 16. The structure of the inkjet printer of this embodiment is practically the same as that of the above embodiment, except for a conveyor 513. Thus, the same symbols as the first embodiment are given to the members other than the conveyor 513, and the descriptions of those members are omitted. The following mainly describes the conveyor 513.

As illustrated in FIG. 15 and FIG. 16, an inkjet printer 501 includes: a conveyor 513; a sheet feed guide 511 provided below the conveyor 513; a sheet discharge guide 512 provided above the conveyor 513; four inkjet heads 1; an image sensor 17; and a cleaning mechanism 18.

The conveyor 513 is for conveying a sheet P, and includes a drum 508 having a cylindrical shape. The drum 508 is a hard member made of a metal or resin. The drum 508 includes a base 508*a* and a detachable plate 508*b*. The base 508*a* has a cylindrical shape having a shaft extended in a direction perpendicular to the surface of FIG. 15. The detachable plate 508*b* has the same width as the base 508*a*. The detachable plate 508*b* may be a resinous or metallic hard member, or a flexible member. The detachable plate 508*b* has a cylindrical shape having an open part extending in the axial direction. This open part, when viewed from the axial direction, forms an arc of approximately thirty degrees angle about the rotation axis. The detachable plate 508*b* has an inner diameter substantially the same as an outer diameter of the base 508*a*. The detachable plate 508*b* is coaxially provided with the base 508*a* so as to cover an external surface of the base 508*a*. An area of the base 508*a* exposed from the detachable plate 508*b* is hereinafter referred to as an ejection target region 508*c*. Brightness of outer surfaces of the ejection target region 508*c* or the detachable plate 508*b* is higher than that of any of ink ejected from the four inkjet heads 1.

The base 508*a* is made of a magnetic material (ferromagnetic material). The detachable plate 508*b* includes a not-illustrated magnetic sheet. Thus, the detachable plate 508*b* is detachably attached to a surface of the base 508*a* by a magnetic force. The base 508*a* has a plurality of suction holes 582*a*. These suction holes 582*a* are formed in a predetermined pattern throughout the external surface of the base 508*a* except for the ejection target region 508*c*. Further, the detachable plate 508*b* has a plurality of suction holes 582*b* formed in the same manner as the suction holes 582*a*. Each of the suction holes 582*b* is connected to an suction hole 582*a*. The suction holes 582*a* and 582*b* communicate an internal space 523 of the drum 508 with an external space of the drum 508.

As illustrated in FIG. 16, both ends of the drum 508 are closed. The centers of surfaces at the both ends of the drum 508 are connected by a hollow shaft 27 which extends in the direction of a rotation axis, and penetrates the surfaces at the end of the drum 508. The hollow shaft 27 is rotatable with the drum 508.

A circumferential wall of the hollow shaft 27 in the internal space 523 has a plurality of communicating holes 27*a*. The communicating holes 27*a* are formed uniformly, and communicate the internal space 523 with the inside of the hollow shaft 27. The left end of the hollow shaft 27 is closed. The right end of the hollow shaft 27 is connected to an air suction device 28 having a fan 28*a*. By driving this air suction device 28, the air in the internal space 523 is sucked into the hollow shaft 27 via the communication holes 27*a*, and is delivered outside the drum 508. This creates airflow from the external space to an internal space 23 through the suction holes 582*a* and 582*b*. Thus, the sheet P is adsorbed on the surface of the detachable plate 508*b*. Further, on a surface of the detachable plate 508*b* is an adhesive layer. Adhesion of the adhesive layer also helps the detachable plate 508*b* to retain the sheet P on the surface. Further, the adhesive layer may be omitted from the surface of the detachable plate 508*b*.

To the left of the hollow shaft 27, a pulley 24 is provided. The pulley 24 is rotatable with the hollow shaft 27. A pulley 29 is provided to a rotation axis of a conveyor motor 25. Further, a belt 26 is looped around the pulleys 24 and 29. The conveyor motor 25 rotates the hollow shaft 27 and the drum 508 counterclockwise in FIG. 15 via the belt 26, the pulleys 24 and 29. This causes the sheet retained on the surface of the detachable plate 508*b* to be conveyed on the surface of the detachable plate 508*b* in a circumferential direction of the drum 508.

Immediately upstream of the sheet discharge guide 512 in the conveyance direction are four inkjet heads 1 aligned in the conveyance direction. An ejection surface 2*a* of each of the inkjet heads 1 faces the external surface of the drum 508. While the sheet P conveyed by the drum 508 is sequentially passing through under the four inkjet heads 1, ink droplets of the respective colors are ejected from the ink ejection faces 2*a* towards an upper surface of the sheet P which is a print surface. Thus, an intended color image is formed on the print surface of the sheet P.

Below the sheet discharge guide 512 is an image sensor 17. In an ejection test of the inkjet heads 1, the image sensor 17 reads out the condition of a dot formed in the ejection target region 508*c* of the drum 508. Immediately downstream of the sheet feed guide 511 in the conveyance direction is a cleaning mechanism 18 which cleans the ejection target region 508*c* in the ejection test of the inkjet heads 1.

An operation of the ejection test of the inkjet heads 1 of this embodiment is practically the same as that of the first embodiment. Thus, the description of the operation is omitted.

In the embodiment, the detachable plate 508*b* is detachably attached to the base 508*a* by magnetic force. Thus, the detachable plate 508*b* is easily detached from the base 508*a*. Thus, the detachable plate 508*b* is easily replaceable.

Further, the conveyor 513 has a drum 508 which does not elastically deform. Thus, the conveyor 513 has excellent durability.

Further, driving the air suction device 28 creates an airflow flow from outside to the drum 508 through the suction holes 282*a* and 282*b*, causing the sheet P to be adsorbed to the external surface of the drum 508. This prevents deterioration in the adhesion force, and the sheet P is stably retained.

ANOTHER MODIFIED EXAMPLE

In the above first embodiment, the base 8*a* on the conveyor belt 8*a* is partly exposed from an ejection target region 8*c*. However, side surfaces of the two detachable plates 8*b* may be in contact with one another. Thus the ejection target regions 8*c* may not be formed.

In the above first embodiment, an adhesive layer is formed on a surface of the detachable plate 8*b*. However, a charged plate having a charge layer on a surface may be provided instead of the detachable plate 8*b*. In this case, the conveyor is preferably provided with a charging mechanism which charges a charged plate, and a discharging mechanism which discharges the charged plate having been charged. Instead of the detachable plate 8*b*, a plate having a plurality of communication holes may be certainly adopted to suck the air from inside the plate.

Further in the first embodiment, two detachable plates 8*b* are attached to an external surface of the base 8*a*. However, the number of detachable plates to be attached to the external surface of the base 8*a* may be one, or three or more. Further in the second embodiment, the number of detachable plates 508*b* to be provided may be any given number at least two.

In order to attach the detachable plate 508*b* to the base 508*a*, the second embodiment may adopt: the recesses and protrusions adopted in the first embodiment; the screws adopted in the first modified example; or the adhesive adopted in the second modified example. Conversely, the first embodiment may adopt a magnet adopted in the second embodiment to attach the detachable plate 8*b* to the base 8*a*. Further in the second embodiment, the ejection target plate described in the third modified example may be attached to the external surface of the base, instead of the ejection target region 8*c*. A method of attaching the ejection target plate to the base may be any one of the above mentioned methods.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a conveyor which includes a circumferential wall, and which conveys a recording medium placed on an outer circumferential surface of the circumferential wall with rotation of the circumferential wall;

a recording head including an ejection surface where a plurality of nozzles are open, which records an image to a recording medium being conveyed by the conveyor by ejecting at least one liquid droplet from the nozzles, the ejection surface being positioned so as to face the outer circumferential surface of the circumferential wall, wherein the circumferential wall includes a tube shaped base, and one or more detachable plates detachably attached to an external surface of the base such that the external surface of the base has an exposed region where the base is partly exposed;

a head controller which controls the recording head so as to eject at least one liquid droplet onto the exposed region; and a cleaning mechanism for cleaning the exposed region, wherein the cleaning mechanism is configured to move a blade across the exposed region in a width direction of the circumferential wall while bringing the blade in contact with the exposed region.

2. The recording apparatus according to claim 1, further comprising:

an ejection status sensor which senses an ejection failure of at least one liquid droplet ejected from the recording head to the exposed region.

3. The recording apparatus according to claim 1, wherein the conveyor further includes a plurality of rollers, and wherein the base is an endless belt looped around the plurality of rollers.

4. The recording apparatus according to claim 1, wherein the base is a cylindrically shaped drum.

5. The recording apparatus according to claim 1, wherein a plurality of suction holes are formed on both of the circumferential wall and the one or more detachable plates, so as to connect an internal space of the circumferential wall to an external space of the circumferential wall;

and wherein the recording device further comprises an suction device which sucks the air from the internal space to create an air flow from the external space to the internal space, through the plurality of suction holes.

6. The recording apparatus according to claim 1, wherein one of the one or more detachable plates and the base has a protrusion while the other one of the one or more detachable plates and the base has a recess, and the one or more detachable plates are attachable to the external surface of the base by fitting the protrusion and recess with each other.

7. The recording apparatus according to claim 1, wherein the one or more detachable plates are attached to the external surface of the base with a fastening bolt which is inserted into a through hole and reaches the base, the through hole being provided to the one or more detachable plates.

8. The recording apparatus according to claim 1, wherein the one or more detachable plates are attached to the external surface of the base with adhesive.

9. The recording apparatus according to claim 1, wherein the one or more detachable plates are attached to the external surface of the base with magnetic force.

10. The recording apparatus according to claim 1, wherein an outer surface of the one or more detachable plates has at least one of an adhesive layer and a charged layer formed thereon.

11. The recording apparatus according to claim 1, wherein brightness of an outer surface of the one or more detachable plates is higher than that of liquid ejected from the recording head.

12. The recording apparatus according to claim 1, wherein the external surface of the base has a plurality of the detachable plates aligned thereon in a circumferential direction of the base.

13. A recording apparatus comprising:

a conveyor which includes a circumferential wall, and which conveys a recording medium placed on an outer circumferential surface of the circumferential wall with rotation of the circumferential wall;

a recording head including an ejection surface where a plurality of nozzles are open, which records an image to a recording medium being conveyed by the conveyor by ejecting at least one liquid droplet from the nozzles, the ejection surface being positioned so as to face the outer circumferential surface of the circumferential wall, wherein the circumferential wall includes a tube shaped base, and a plurality of the detachable plates are detachably attached to an external surface of the base so that they are aligned thereon in a circumferential direction of the base;

a head controller which controls the recording head so as to eject at least one liquid droplet on an outer surface of an ejection target plate which is a part of the plurality of the detachable plates, wherein a brightness of the outer surface of the ejection target plate is higher than a brightness of the liquid ejected from the recording head; and an ejection status sensor which senses an ejection failure of a liquid droplet ejected from the recording head to a surface of the ejection target plate.

14. The recording apparatus according to claim 10, wherein surface roughness of the ejection target plate is smaller than that of any of the other one or more detachable plates.

15. The recording apparatus according to claim 1, wherein an outer surface of the one or more detachable plates has a groove extending outwardly with respect to a width direction of the circumferential wall, towards upstream in a rotation direction of the circumferential wall.

16. A recording apparatus comprising:

a conveyor which includes a circumferential wall, and which conveys a recording medium placed on an outer circumferential surface of the circumferential wall with rotation of the circumferential wall;

a recording head including an ejection surface where a plurality of nozzles are open, which records an image to a recording medium being conveyed by the conveyor by ejecting at least one liquid droplet from the nozzles, the ejection surface being positioned so as to face the outer circumferential surface of the circumferential wall, wherein the circumferential wall includes a tube shaped base, and one or more detachable plates detachably attached to an external surface of the base; and a cleaning mechanism for cleaning a region in the outer circumferential surface of the circumferential wall where the plurality of ejected liquid droplets land, wherein the cleaning mechanism is configured to move a blade across the circumferential wall in the width direction of the circumferential wall while bringing the blade in contact with the outer circumferential surface of the circumferential wall.

17. The recording apparatus according to claim 16, wherein the blade is made of an elastic material and is longer in the circumferential direction of the circumferential wall than the region.

* * * * *